US012617007B2

(12) United States Patent
Dong et al.

(10) Patent No.: US 12,617,007 B2
(45) Date of Patent: May 5, 2026

(54) ANTI-COLLAPSE OIL CASING WITH HIGH STRENGTH AND MANUFACTURING METHOD THEREFOR

(71) Applicant: Baoshan Iron & Steel Co., Ltd., Shanghai (CN)

(72) Inventors: Xiaoming Dong, Shanghai (CN); Zhonghua Zhang, Shanghai (CN); Weiguo Yang, Shanghai (CN); Jiaming Liu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 561 days.

(21) Appl. No.: 17/922,548

(22) PCT Filed: May 6, 2021

(86) PCT No.: PCT/CN2021/091903
§ 371 (c)(1),
(2) Date: Oct. 31, 2022

(87) PCT Pub. No.: WO2021/227921
PCT Pub. Date: Nov. 18, 2021

(65) Prior Publication Data

US 2023/0211396 A1 Jul. 6, 2023

(30) Foreign Application Priority Data

May 11, 2020 (CN) ..... 202010392682.0

(51) Int. Cl.

| | |
|---|---|
| ***B21B 19/04*** | (2006.01) |
| ***B21B 19/10*** | (2006.01) |
| ***B21B 37/74*** | (2006.01) |
| ***B21D 37/16*** | (2006.01) |
| ***C21D 1/25*** | (2006.01) |
| ***C22C 30/00*** | (2006.01) |

(52) U.S. Cl.
CPC ..... *B21B 19/04* (2013.01); *B21B 19/10* (2013.01); *B21B 37/74* (2013.01); *B21D 37/16* (2013.01); *C21D 1/25* (2013.01); *C22C 30/00* (2013.01)

(58) Field of Classification Search
CPC ..... B21B 19/04; B21B 19/10; B21B 37/74; B21D 37/16; B21D 3/00; C21D 1/25; C21D 1/06; C21D 1/18; C21D 1/60; C21D 6/002; C21D 6/02; C21D 2211/003; C21D 2211/005; C21D 7/13; C21D 8/10; C21D 9/08; C21D 9/085; C22C 30/00; C22C 38/001; C22C 38/02; C22C 38/04; C22C 38/06; C22C 38/22; C22C 38/24; C22C 38/26; C22C 38/28; C22C 38/32
See application file for complete search history.

(56) References Cited

U.S. PATENT DOCUMENTS

| | | | | |
|---|---|---|---|---|
| 2006/0018783 | A1* | 1/2006 | Itou | C22C 38/22 420/84 |
| 2007/0012383 | A1 | 1/2007 | Numata et al. | |
| 2017/0159157 | A1 | 6/2017 | Dong et al. | |
| 2019/0226063 | A1 | 7/2019 | Arai et al. | |

FOREIGN PATENT DOCUMENTS

| | | | |
|---|---|---|---|
| CN | 1727510 | A | 2/2006 |
| CN | 1873041 | A | 12/2006 |
| CN | 1934279 | A | 3/2007 |
| CN | 101413088 | A | 4/2009 |
| CN | 101532113 | A | 9/2009 |
| CN | 103774063 | A | 5/2014 |
| CN | 105441801 | A | 3/2016 |
| CN | 107723598 | A | 2/2018 |
| CN | 108624810 | A | 10/2018 |
| CN | 109161788 | A | 1/2019 |

(Continued)

OTHER PUBLICATIONS

Vander Voort, G.F. "Glossary of Terms." ASM Handbook, vol. 9: Metallography and Microstructures. pp. 1115-1134. 2004. (Year: 2004).*

Ozdemir et al. Fen Bilimleri Dergisi, 25(20) 2013 75-90 (Year: 2013).*

Tempering Temps DMH United Steel Industry Website (Year: 2019).*

International Searching Authority—International Search Report, pertaining to International Application No. PCT/CN2021/091903 dated Jul. 23, 2021, together with the Written Opinion of the International Searching Authority, 12 pages.

(Continued)

*Primary Examiner* — Danielle M. Carda
(74) *Attorney, Agent, or Firm* — Barclay Damon LLP

(57) ABSTRACT

An anti-collapse oil casing with high strength and a manufacturing method therefor, comprising the following chemical elements in percentage by mass: C: 0.08%-0.18%; Si: 0.1%-0.4%; Mn: 0.1%-0.28%; Cr: 0.2%-0.8%; Mo: 0.2%-0.6%; Nb: 0.02%-0.08% b; V: 0.01%-0.15%; Ti: 0.02%-0.05%; B: 0.0015%-0.005%; and Al: 0.01%-0.05%. The manufacturing method for the anti-collapse oil casing with high strength comprises the steps of: (1) smelting and continuous casting; (2) perforating, rolling, and sizing; (3) controlled cooling: the initial cooling temperature being Ar3+50° C. and the final cooling temperature being ≤80° C.; the cooling step being performed only to the outer surface of the casing without performing to the inner wall of the casing; and the rate of the controlled cooling being 30-70° C./s; (4) tempering; and (5) thermal straightening. The anti-collapse oil casing with high strength according to the present invention has reasonable chemical composition and process design, which not only has excellent economic efficiency, but also has high strength, high toughness and high anti-collapse performance.

12 Claims, No Drawings

(56) References Cited

FOREIGN PATENT DOCUMENTS

CN 109642293 A 4/2019

OTHER PUBLICATIONS

Extended European Search Report in Application No. 21803349.6 dated Aug. 22, 2023, 13 pages.

Notice of Reasons for Refusal in Japanese Patent Application No. 2022-565740 dated Oct. 31, 2023 [with English translation], 7 pages.

Conclusion Regarding Patentability of an Invention in Russian Patent Application No. 202292817/31 dated Mar. 29, 2023 [with English translation], 6 pages.

* cited by examiner

ANTI-COLLAPSE OIL CASING WITH HIGH STRENGTH AND MANUFACTURING METHOD THEREFOR

CROSS-REFERENCE TO RELATED APPLICATIONS

This application is a U.S. national phase entry under 35 USC § 371 of Patent Cooperation Treaty Application No. PCT/CN2021/091903 filed May 6, 2021, which in turn claims priority from Chinese Patent Application 202010392682.0 filed May 11, 2020. Each of the above described applications is hereby incorporated herein by reference in their entireties.

TECHNICAL FIELD

The present invention relates to a metal material and a manufacturing method therefor, in particular to an oil casing and a manufacturing method therefor.

BACKGROUND

With the increasing depth and difficulty of oil & gas resource exploitation domestically or abroad at present, the fluid field, pressure field or the like of the stratum will undergo great changes, and the service conditions and stress conditions of casings for oil and water wells are also becoming more complex. About 20% of oil and water wells in China have encountered casing collapses, or even 50% or more in particular regions. A collapsed casing may affect the regular production of crude oil in mild cases, and in severe cases, the entire oil well will be scrapped, which causes huge economic loss. Therefore, in order to sufficiently exploit the existing resources, to improve the recovery efficiency and to reduce unnecessary loss, it is essential to effectively solve the problem of casing collapse.

At present, a number of domestic or abroad research work have been completed on mechanisms, influencing factors, detection methods of casing collapse, as well as the research and development of casings having high anti-collapse performance, which provide a series of casing products for different steel grades and different specifications, which have been applied in oil field exploitation and production at present, but the industrial and mining conditions of the oil field in service are not only extremely complex, but are also greatly different between each oil fields. Therefore, it put forward more differentiated demands for anti-collapse casings.

The Japanese patent having publication No. JPH11-131189A which published on May 18, 1999 and entitled as "Manufacturing Method of Steel Pipe" discloses a manufacturing method of a steel pipe. In the manufacturing method, heating is performed within a temperature range of 750-400° C., and rolling is performed within a range of deformation of 20% or 60%, so as to produce a steel pipe product having a yield strength of 950 Mpa or more and good toughness. However, due to the low heating temperature of this technique, the difficulties for rolling would be high. In addition, low rolling temperature would cause the formation of martensite structure which is not desired in oil casing products.

The Japanese patent having publication No. JP04059941A which published on Feb. 26, 1992 and entitled as "Tough High-Strength TRIP Steel" recites that the tensile strength can reach 120-160 ksi by controlling the proportions of retained austenites (20%-45%) and upper bainites in the steel substrate through thermal treatment process. The composition design mentioned in this patent are characterized by high carbon and high silicon content. The two components can significantly increase the strength, however, it would also reduce the toughness. At the same time, the retained austenites may undergo structural transformation during the use of the oil pipe (the service temperature of the oil pipe for a deep well is 120° C. or more), which will improve the strength while reduce the toughness.

SUMMARY OF THE INVENTION

One of the objectives of the present invention is to provide an anti-collapse oil casing with high strength. In the chemical component design of the anti-collapse oil casing with high strength, Cr and B are added to replace Mn to increase the hardenability of steel, and Ti is used to suppress the embrittlement effect of N on grain boundaries, thereby reducing the cost for the alloying elements added into the oil casing and preventing quench cracking. The anti-collapse oil casing has high strength, high toughness and high anti-collapse performance, and specifically has a yield strength of 758-965 MPa, a tensile strength of ≥862 MPa, an elongation rate of ≥18% and a residual stress of ≤120 MPa, and has a 0° C. transverse charpy impact energy of ≥80 J. Moreover, the anti-collapse strength is 55 MPa or more at a typical specification of Φ244.48*11.99 mm, which exceeds the required value of the API standard by 40% or more, so that the high-strength anti-collapse oil casing can meet the demands required by deep wells and oil & gas fields with respect to strength and anti-collapse performance of the oil well casings.

In order to achieve the above-mentioned objective, the present invention provides an anti-collapse oil casing with high strength, comprising the following chemical elements in percentage by mass:

C: 0.08-0.18%;
Si: 0.1-0.4%;
Mn: 0.1-0.28%;
Cr: 0.2-0.8%;
Mo: 0.2-0.6%;
Nb: 0.02-0.08%;
V: 0.01-0.15%;
Ti: 0.02-0.05%;
B: 0.0015-0.005%; and
Al: 0.01-0.05%.

Preferably, in the anti-collapse oil casing with high strength of the present invention, the content of each chemical element in percentage by mass satisfies the following:

C: 0.08-0.18%;
Si: 0.1-0.4%;
Mn: 0.1-0.28%;
Cr: 0.2-0.8%;
Mo: 0.2-0.6%;
Nb: 0.02-0.08%;
V: 0.01-0.15%;
Ti: 0.02-0.05%;
B: 0.0015-0.005%;
Al: 0.01-0.05%; and
the balance of Fe and other inevitable impurities.

In the anti-collapse oil casing with high strength of the present invention, the design principle of each chemical element is as follows:

C: In the anti-collapse oil casing with high strength of the present invention, C is a carbide-forming element, which can effectively increase the strength of steel. When the mass percentage of C is less than 0.08%, the hardenability of the steel may be reduced, thereby reducing the toughness of the steel. However, when the mass percentage of C is greater than 0.18%, the segregation of the steel may be significantly deteriorated, and cause quench cracks easily. Therefore, in order to meet the demand for high strength of the oil casing, the mass percentage of C in the anti-collapse oil casing with high strength of the present invention is controlled to be 0.08-0.18%.

In some preferred embodiments, the mass percentage of C can be controlled to be 0.1-0.16% to improve the hardenability and suppress the quench cracks.

Si: In the anti-collapse oil casing with high strength of the present invention, Si is solid solutionized in ferrite, which can improve the yield strength of the steel. However, adding high amount of Si in the steel is not advisable because too much Si may deteriorate the workability and toughness of the steel. However, it should be noted that the oil casing would oxidize easily if the mass percentage of Si in the steel is less than 0.1%. Therefore, the mass percentage of Si in the anti-collapse oil casing with high strength of the present invention is controlled to be 0.1-0.4%.

In some preferred embodiments, the mass percentage of Si can be controlled to be 0.15-0.35% to improve the workability and toughness of the steel.

Mn: In the anti-collapse oil casing with high strength of the present invention, Mn is an austenite forming element, which can increase the hardenability of the steel. In the steel system of the anti-collapse oil casing with high strength of the present invention, when the mass percentage of Mn is less than 0.1%, the hardenability of the steel may be significantly reduced, and the proportion of martensite in the steel may be reduced subsequently, which leads to a decrease in the toughness of the steel. However, it should be noted that high amount of Mn in the steel is not advisable, either. When the mass percentage of Mn is greater than 0.28%, component segregation will occur easily and cause quench cracks. Therefore, the mass percentage of Mn in the anti-collapse oil casing with high strength of the present invention is controlled to be 0.1-0.28%.

In some preferred embodiments, the mass percentage of Mn can be controlled to be 0.15-0.25% to increase the hardenability and improve segregation.

Cr: In the anti-collapse oil casing with high strength of the present invention, as an element that greatly improves the hardenability and a strong carbide-forming element, Cr can precipitate carbides during tempering thereby increasing the strength of the steel. However, it should be noted that in the steel system of the anti-collapse oil casing with high strength of the present invention, when the mass percentage of Cr is greater than 0.8%, coarse $M_{23}C_6$ carbides would easily precipitate at the grain boundaries, which reduces the toughness of the steel and causes quench cracking easily; and when the mass percentage of Cr is less than 0.2%, the hardenability will not suffice. Therefore, the mass percentage of Cr in the anti-collapse oil casing with high strength of the present invention is controlled to be 0.2-0.8%.

In some preferred embodiments, the mass percentage of Cr can be controlled to be 0.4-0.7% to improve the toughness and the hardenability.

Mo: In the anti-collapse oil casing with high strength of the present invention, Mo increases the strength and tempering stability of the steel mainly by means of carbide and solid solution strengthening. In the steel system of the anti-collapse oil casing with high strength of the present invention, when the mass percentage of Mo added to the steel exceeds 0.6% or more, quench cracks would easily occur. However, it should be noted that once the mass percentage of Mo is less than 0.2%, the strength of the oil casing would not be able to meet the demand for high strength. Therefore, the mass percentage of Mo in the anti-collapse oil casing with high strength of the present invention is controlled to be 0.2-0.6%.

In some preferred embodiments, the mass percentage of Mo can be controlled to be 0.25-0.5% to further improve the strength and suppress quench cracks.

Nb: In the anti-collapse oil casing with high strength of the present invention, Nb is a fine-grained forming and precipitation-strengthening element in the steel, which can compensate for the decrease in strength caused by low carbon content. In addition, Nb can form NbC precipitates and can effectively refine austenite grains. However, it should be noted that in the steel system of the anti-collapse oil casing with high strength of the present invention, when the content of Nb in the steel is less than 0.02%, the effect achieved by the addition of Nb would not be obvious; and when the content of Nb is greater than 0.08%, coarse Nb (CN) will be easily produced, thereby reducing the toughness of the steel. Therefore, the mass percentage of Nb in the anti-collapse oil casing with high strength of the present invention is controlled to be 0.02-0.08%.

In some preferred embodiments, the mass percentage of Nb can be controlled to be 0.02-0.06% to further improve the toughness and the strength.

V: In the anti-collapse oil casing with high strength of the present invention, V is a typical precipitation-strengthening element, which can compensate for the decrease in strength caused by the decrease of carbon. It should be noted that when the content of V in the steel is less than 0.01%, the strengthening effect of V will not be obvious. When the content of V in the steel is greater than 0.15%, coarse V(CN) will be easily produced, thereby reducing the toughness of the steel. Therefore, the mass percentage of V in the anti-collapse oil casing with high strength of the present invention is controlled to be 0.01-0.15%.

In some preferred embodiments, the mass percentage of V can be controlled to be 0.05-0.12% to further improve the toughness and the strength.

Ti: In the anti-collapse oil casing with high strength of the present invention, Ti is a strong-carbonitride-forming element, which can significantly refine the austenite grains in the steel and can compensate for the decrease in strength caused by the decrease in the carbon content. In the steel system of the anti-collapse oil casing with high strength of the present invention, if the content of Ti in the steel is greater than 0.05%, coarse TiN will be easily formed, thereby reducing the toughness of the steel. If the content of Ti in the steel is less than 0.02%, Ti will not able to fully react with N to form TiN, and B in the steel may then react with N to form a brittle phase BN, resulting in a decrease in the toughness of the steel. Therefore, the mass percentage of Ti in the anti-collapse oil casing with high strength of the present invention is controlled to be 0.02-0.05%.

In some preferred embodiments, the mass percentage of Ti can be controlled to be 0.02-0.04% to further improve the toughness.

B: In the anti-collapse oil casing with high strength of the present invention, B is also an element that can significantly increase the hardenability of the steel. B can solve the problem of low hardenability caused by the decrease in the content of C. However, in the steel system of the anti-collapse oil casing with high strength of the present invention, when the content of B in the steel is less than 0.0015%, the effect of increasing the hardenability of the steel brought by B would not be significant. Moreover, if the content of B in the steel is too high, for example, greater than 0.005%, a brittle phase BN will be formed easily, thereby reducing the toughness of the steel. Therefore, in the anti-collapse oil casing with high strength of the present invention, the mass percentage of B is controlled to be 0.0015-0.005%.

In some preferred embodiments, the mass percentage of B can be controlled to be 0.0015-0.003% to further improve the toughness and the hardenability.

Al: In the anti-collapse oil casing with high strength of the present invention, Al is a good deoxidization and nitrogen-fixing element, which can effectively refine the grains. The mass percentage of Al in the anti-collapse oil casing with high strength of the present invention is controlled to be 0.01-0.05%.

In some preferred embodiments, the mass percentage of Al can be controlled to be 0.015-0.035% to further improve the deoxidation effect and inhibit inclusions.

Preferably, in the anti-collapse oil casing with high strength of the present invention, the inevitable impurities include S, P and N, and their contents satisfy at least one of: P≤0.015%, N≤0.008%, and S≤0.003%.

In the above technical solutions, in the anti-collapse oil casing with high strength of the present invention, P, N and S are all inevitable impurity elements in the steel, and the lower their contents in the steel, the better.

Preferably, in the anti-collapse oil casing with high strength of the present invention, the content of each chemical element in percentage by mass satisfies at least one of the following:

C: 0.1-0.16%;
Si: 0.15-0.35%;
Mn: 0.15-0.25%;
Cr: 0.4-0.7%;
Nb: 0.02-0.06%;
V: 0.05-0.12%;
Ti: 0.02-0.04%;
B: 0.0015-0.003%; and
Al: 0.015-0.035%.

Preferably, in the anti-collapse oil casing with high strength of the present invention, the microstructure of the oil casing is tempered sorbite.

Preferably, in the anti-collapse oil casing with high strength of the present invention, the properties thereof satisfy at least one of the following: a yield strength of 758-965 MPa, a tensile strength of ≥862 MPa, an elongation rate of ≥18%, a residual stress of ≤120 MPa, a 0° C. transverse charpy impact energy of ≥80 J, and an anti-collapse strength of 55 MPa or more for a specification of Φ244.48*11.99 mm, which exceeds the required value of the API standard by 40% or more.

Correspondingly, another objective of the present invention is to provide a manufacturing method for the above-mentioned anti-collapse oil casing with high strength. The manufacturing method is specifically aimed at the oil casing having the above chemical elements with specific amount. The production cost of the manufacturing method is relatively low, and the anti-collapse oil casing with high strength obtained by adopting the chemical elements of the specific amount in accordance with the present invention and in combination with the present manufacturing method can meet the following properties at the same time: a yield strength of 758-965 MPa, a tensile strength of ≥862 MPa, an elongation rate of ≥18%, a residual stress of ≤120 MPa, a 0° C. transverse charpy impact energy of ≥80 J, and an anti-collapse strength of 55 MPa or more for the specification of Φ244.48*11.99 mm, which exceeds the required value of the API standard by 40% or more, so that the anti-collapse oil casing with high strength can sufficiently meet the demand required by deep wells and oil and gas fields with respect to strength and anti-collapse performance of the oil well casings. That is to say, the anti-collapse oil casing with high strength obtained by the specific chemical component ratios of the present invention in combination with the manufacturing method for the oil casing of the present invention can achieve the best performance.

In order to achieve the above-mentioned objectives, the present invention provides a manufacturing method suitable for the anti-collapse oil casing with high strength having the above-mentioned chemical element ratios, comprising the steps of:

(1) smelting and continuous casting;
(2) perforating, rolling, and sizing;
(3) controlled cooling: an initial cooling temperature being Ar3+30° C. to Ar3+70° C. (including Ar3+30° C. and Ar3+70° C.), wherein Ar3 refers to an initial temperature of ferritic transformation during cooling, and the initial cooling temperature is further controlled to be Ar3+50° C.; a final cooling temperature being ≤80° C.; the cooling step being only performed to an outer surface of the casing without performing to an inner wall of the casing. For example, water can be sprayed to cool the outer surface of the casing, and controlling a cooling rate to be 30-70° C./s;
(4) tempering; and
(5) thermal straightening.

The manufacturing method in prior art usually adopts an offline quenching+tempering process. Specifically, the process comprises cooling the hot rolled casing to room temperature, reheating to austenitizing temperature in a furnace, cooling the casing to room temperature by water cooling and finally performing tempering. In the manufacturing method of the present invention, different from the offline quenching+tempering thermal treatment process used for conventional anti-collapse casing, the manufacturing method for the anti-collapse oil casing with high strength of the present invention utilizes the residual heat of the hot rolled steel casing for quenching, that is, the hot rolled steel casing is quenched to room temperature by the residual heat, and then performing tempering, which eliminates the reheating step. The manufacturing method of the present invention eliminates the offline quenching procedure and achieves the effect equivalent to online quenching, and with the corporation of thermal tempering treatment for production, the production efficiency can be significantly increased while reducing the production cost, and the energy consumption and green production can be achieved.

It should be noted that the difference between the controlled cooling process and the conventional offline quenching is that the controlled cooling process of the present invention only cools the outer surface of the casing during the cooling step, while not performing cooling to the inner wall of the casing. Such cooling method can significantly reduce the residual stress on the casing body, and is beneficial to increasing the anti-collapse performance. However, it should be noted that in order to ensure the high strength of the obtained high-strength anti-collapse casing, more alloying elements are usually needed to improve the strengthening effect. Since the casing directly undergoes controlled cooling after hot-rolling, the casing would store high energy because of grain distortion, which would easily lead to cracks during the controlled cooling process. Therefore, in the manufacturing method of the present invention, the types and contents of the alloying elements need to be optimally designed to prevent generation of cracks and stress concentration in the anti-collapse casing with high strength in order to ensure the safety of production and stable quality.

Mn in the anti-collapse casing with high strength would easily cause dendritic segregation, resulting in regional alloy enrichment and high hardness, which would lead to generation of quench cracks easily. Therefore, in order to solve the problem of insufficient hardenability of low-carbon steels, B is added to increase the hardenability and the martensite content after quenching; and a more uniform tempered sorbite structure can be formed after thermal tempering treatment to ensure the strength and toughness of the anti-collapse oil casing with high strength. The purposes of the present invention are to form a microstructure of tempered sorbite after the tempering, and of course, some other undesired microstructures may be inevitably included. The purposes of the present invention are to form a microstructure of tempered sorbite with a volume fraction close to 100%; further, the volume fraction can reach 95% or more, and further controlled to be 98% or more. Other inevitable microstructures are, for example, retained austenites or ferrites, or a combination thereof. The volume fraction of these inevitable microstructure components is controlled to be within 5% (including 5%), and further controlled to be within 2% (including 2%). Correspondingly, the microstructures after quenching mainly include martensites and few amounts of retained austenites and/or ferrites, wherein the volume fraction of the martensites is 95% or more, while the remaining volume fraction of retained austenites and/or ferrites is 5% or below. The microstructure of tempered sorbite is more favorable for the oil casing to have both high strength and good toughness.

Preferably, in the manufacturing method of the present invention, in the continuous casting of the step (1), controlling the superheat degree of molten steel to be less than 30° C., and a pulling rate of the continuous casting to be 1.6-2.0 m/min, so as to further improve segregation.

Preferably, in the manufacturing method of the present invention, in the step (2), a round billet is subjected to soaking in a furnace at 1260-1290° C.; a perforating temperature is controlled to be 1180-1260° C.; a final rolling temperature is controlled to be 900-980° C.; and a sizing temperature after final rolling is 850-920° C., which further improves the stability of the microstructure after rolling.

Preferably, in the manufacturing method of the present invention, in the step (4), a tempering temperature is 500-600° C.; and a holding time is 50-80 min to further improve the performance stability.

Preferably, in the manufacturing method of the present invention, in the step (4), a thermal straightening temperature is 400-500° C. to improve the straightness of the steel casing.

Compared with the prior art, the anti-collapse oil casing with high strength and the manufacturing method therefor have the following advantages and beneficial effects.

In the chemical component design of the anti-collapse oil casing with high strength of the present invention, Cr and B are added to replace Mn to increase the hardenability of steel, and Ti is used to suppress the embrittlement effect of N on grain boundaries, thereby reducing the cost for the alloying elements added into the oil casing, and preventing quench cracking effectively. The anti-collapse oil casing with high strength has a yield strength of 758-965 MPa, a tensile strength of ≥862 MPa, an elongation rate of ≥18% and a residual stress of ≤120 MPa, and has a 0° C. transverse charpy impact energy of ≥80 J. The anti-collapse strength is 55 MPa or more for a specification of Φ244.48*11.99 mm, which exceeds the required value of the API standard by 40% or more, so that the demands required by deep wells and oil & gas fields with respect to strength and anti-collapse performance of oil wells casings can be satisfied.

In addition, according to the manufacturing method for the anti-collapse oil casing with high strength of the present invention, the steel obtains high strength and good toughness by adopting a technology of thermo-mechanical control process (TMCP); the operation process of the manufacturing method is simple, and the production cost is low, while large-scale production and manufacturing are easy to realize, and thus achieving good economic benefits.

DETAILED DESCRIPTION

The anti-collapse oil casing with high strength and the manufacturing method therefor of the present invention are further explained and illustrated below in combination with specific examples. However, the explanation and illustration do not improperly limit the technical solutions of the present invention.

Examples 1-6 and Comparative Examples 1-4

Table 1 lists the chemical elements of each anti-collapse oil casing with high strength of Examples 1-6 and Comparative examples 1-4 in percentage by mass.

TABLE 1

(wt %, the balance of Fe and inevitable impurities except P, S and N)

| | Chemical elements | | | | | | | | | | | | |
|---|---|---|---|---|---|---|---|---|---|---|---|---|---|
| No. | C | Si | Mn | Cr | Mo | Nb | Ti | B | Al | N | V | P | S |
| Example 1 | 0.08 | 0.15 | 0.1 | 0.2 | 0.2 | 0.02 | 0.02 | 0.0015 | 0.01 | 0.004 | 0.01 | 0.015 | 0.001 |
| Example 2 | 0.10 | 0.1 | 0.15 | 0.4 | 0.25 | 0.04 | 0.025 | 0.002 | 0.04 | 0.005 | 0.03 | 0.008 | 0.0015 |
| Example 3 | 0.12 | 0.35 | 0.25 | 0.6 | 0.4 | 0.06 | 0.04 | 0.003 | 0.05 | 0.006 | 0.05 | 0.007 | 0.002 |
| Example 4 | 0.16 | 0.4 | 0.2 | 0.8 | 0.6 | 0.08 | 0.04 | 0.004 | 0.035 | 0.007 | 0.12 | 0.011 | 0.0025 |
| Example 5 | 0.18 | 0.25 | 0.25 | 0.7 | 0.5 | 0.05 | 0.05 | 0.005 | 0.015 | 0.008 | 0.15 | 0.005 | 0.003 |
| Example 6 | 0.14 | 0.25 | 0.2 | 0.6 | 0.4 | 0.04 | 0.05 | 0.003 | 0.02 | 0.008 | 0.11 | 0.005 | 0.003 |
| Comparative example 1 | 0.25 | 0.26 | 1.2 | 0.4 | 0.4 | 0.04 | 0.02 | 0.0015 | 0.023 | 0.008 | 0.05 | 0.008 | 0.0015 |
| Comparative example 2 | 0.15 | 0.33 | 1.2 | 1.5 | 0.3 | 0.03 | — | — | 0.04 | 0.005 | 0.03 | 0.007 | 0.002 |
| Comparative example 3 | 0.12 | 0.3 | 0.3 | 0.4 | 0.4 | — | 0.04 | 0.003 | 0.05 | 0.006 | — | 0.011 | 0.0025 |
| Comparative example 4 | 0.18 | 0.3 | 0.8 | 0.3 | 0.4 | 0.04 | 0.02 | 0.004 | 0.05 | 0.008 | 0.06 | 0.005 | 0.003 |

The anti-collapse oil casing with high strength of Examples 1-6 of the present invention and the Comparative examples 1-4 were all prepared by the following steps.

(1) Smelting and continuous casting: in the continuous casting step, controlling the superheat degree of molten steel to be less than 30° C., and the pulling rate of the continuous casting was controlled to be 1.6-2.0 m/min.

(2) Perforating, rolling and sizing: the round billet was subjected to soaking in a furnace at 1260-1290° C.; the perforating temperature was controlled to be 1180-1260° C.; the final rolling temperature was controlled to be 900-980° C.; and the sizing temperature after final rolling was 850-920° C.

(3) Controlled cooling: the initial cooling temperature was Ar3+30° C. to Ar3+70° C., and the final cooling temperature was ≤80° C.; the cooling step was performed only to the outer surface of the casing without performing to the inner wall of the casing; the cooling rate was controlled to be 30-70° C./s; specifically, the hot rolled casing undergoes the controlled cooling step while maintaining the high-temperature state after the sizing; cooling equipment was a cooling water ring with controllable water amount and pressure which sprays water to cool the outer surface of the casing body; the initial cooling temperature was Ar3+50° C., and the casing was subjected to water cooling at ≤80° C. Such process is online quenching.

(4) Tempering: the tempering temperature was 500-600° C., and the holding time was 50-80 min.

(5) Thermal straightening: the thermal straightening temperature was 400-500° C.

Table 2-1 and Table 2-2 list specific process parameters of the manufacturing methods for the anti-collapse oil casing with high strength of Examples 1-6 and Comparative examples 1-4.

TABLE 2-1

| | Step (1) | | | Step (2) | | |
|---|---|---|---|---|---|---|
| No. | Superheat degree (° C.) | Pulling speed of continuous casting (m/min) | Temperature in the furnace (° C.) | Perforating temperature (° C.) | Final rolling temperature (° C.) | Sizing temperature (° C.) |
| Example 1 | 15 | 2.0 | 1260 | 1180 | 900 | 880 |
| Example 2 | 20 | 1.8 | 1270 | 1200 | 910 | 850 |
| Example 3 | 30 | 1.6 | 1280 | 1210 | 930 | 870 |
| Example 4 | 25 | 1.8 | 1290 | 1190 | 960 | 920 |
| Example 5 | 20 | 1.8 | 1260 | 1260 | 980 | 890 |
| Example 6 | 20 | 1.7 | 1260 | 1260 | 970 | 900 |
| Comparative example 1 | 15 | 1.9 | 1260 | 1220 | 930 | 920 |
| Comparative example 2 | 20 | 1.8 | 1270 | 1210 | 920 | 860 |
| Comparative example 3 | 30 | 1.6 | 1280 | 1210 | 930 | 870 |
| Comparative example 4 | 25 | 1.9 | 1290 | 1240 | 980 | 890 |

TABLE 2-2

| | Step (3) | | | Step (4) | | Step (5) | |
|---|---|---|---|---|---|---|---|
| No. | Initial cooling temperature (° C.) | Cooling rate (° C./s) | Final cooling temperature (° C.) | Tempering temperature (° C.) | Holding time (min) | Thermal straightening temperature (° C.) | Ar3 (° C.) |
| Example 1 | 910 | 30 | 20 | 540 | 50 | 400 | 858 |
| Example 2 | 880 | 40 | 30 | 520 | 60 | 420 | 817 |
| Example 3 | 870 | 50 | 40 | 590 | 60 | 440 | 812 |
| Example 4 | 840 | 60 | 60 | 580 | 80 | 460 | 784 |
| Example 5 | 840 | 70 | 80 | 550 | 70 | 480 | 784 |
| Example 6 | 850 | 50 | 70 | 560 | 75 | 500 | 802 |
| Comparative example 1 | 780 | 40 | 40 | 520 | 70 | 420 | 699 |
| Comparative example 2 | 790 | 50 | 60 | 570 | 60 | 440 | 721 |
| Comparative example 3 | — | — | — | 590 | 60 | 460 | 811 |
| Comparative example 4 | 820 | 60 | 150 | 600 | 60 | 480 | 754 |

The above anti-collapse oil casing with high strength of Examples 1-6 and Comparative examples 1-4 are made to form casings having a specification of Φ244.48*11.99 mm, which are then tested in various properties. The obtained results are listed in Table 3.

Table 3 lists the test results of the mechanical properties of the anti-collapse oil casing with high strength of Examples 1-6 and Comparative examples 1-4. The yield strength, the tensile strength, the elongation rate, and the transverse impact energy are measured in accordance with API SPEC 5CT, and the anti-collapse strength and the residual stress are measured in accordance with ISO/TR10400.

TABLE 3

| No. | Yield strength (MPa) | Tensile strength (MPa) | Elongation rate (%) | 0° C. transverse impact energy (J) | Anti-collapse strength (MPa) | Residual strength (MPa) |
|---|---|---|---|---|---|---|
| Example 1 | 810 | 870 | 26 | 115 | 59 | 80 |
| Example 2 | 830 | 910 | 24 | 102 | 61 | 60 |
| Example 3 | 790 | 970 | 23 | 98 | 58 | 90 |
| Example 4 | 900 | 990 | 21 | 95 | 65 | 50 |
| Example 5 | 960 | 1060 | 20 | 88 | 68 | 100 |
| Example 6 | 910 | 1010 | 21 | 110 | 65 | 85 |
| Comparative example 1 | 920 | 990 | 18 | 30 | 56 | 70 |
| Comparative example 2 | 720 | 800 | 25 | 85 | 49 | 80 |
| Comparative example 3 | 730 | 790 | 24 | 90 | 52 | 170 |
| Comparative example 4 | 750 | 830 | 19 | 60 | 57 | 130 |

In combination with Table 1 and Table 3, the chemical components and related process parameters of the anti-collapse oil casing with high strength of Examples 1-6 all satisfy the design specifications required by the present invention. The components of Example 6 are within the preferred component range, and leads to better performance indexes. For Comparative example 1, the content of C in the chemical component design exceeds the scope defined by the technical solution of the present invention, and the initial cooling temperature also exceeds the scope defined by the technical solution of the present invention. For Comparative example 2, B and Ti are not added in the chemical component design. For Comparative example 3, V and Nb are not added, while offline quenching+tempering process were adopted instead of the controlled cooling process, wherein the quenching temperature was 900° C. and holding for 40 min, and the parameters of the tempering process are as shown in Table 2-2, and as a result, the obtained casing body had high residual stress. For Comparative example 4, the contents of Mn and Cr in the chemical component design exceeds the scope defined by the technical solution of the present invention, and the final cooling temperature exceeds the range defined by the technical solution of the present invention. At least one mechanical property of the casings in Comparative examples 1-4 failed to meet the standards of the oil casing with high strength, high toughness and high anti-collapse performance.

It can be seen from Table 3 that each Examples of the present invention has a yield strength of ≥758 Mpa, a tensile strength of ≥862 Mpa, a 0° C. transverse impact energy of ≥80 J, an elongation rate of ≥18%, a residual stress of ≤120 MPa, and an anti-collapse strength of ≥55 MPa, which exceeded the API standard by 50% or more (the API standard value is 36.5 MPa), that is, the anti-collapse oil casing with high strength in Examples 1-6 have high strength, high toughness and high anti-collapse performance, and suitable for making oil casings for deep well exploitation.

It should be noted that the above-listed examples are only specific examples of the present invention. Obviously, the present invention is not limited to the above examples, and similar changes or modifications made subsequently can be directly derived or be easily conceived by those skilled in the art based on the disclosure of the present invention, and should all fall within the protection scope of the present invention.

What is claimed is:

1. An oil casing, comprising the following chemical elements in percentage by mass:

C: 0.08-0.18%;
Si: 0.1-0.4%;
Mn: 0.1-0.28%;
Cr: 0.2-0.8%;
Mo: 0.2-0.6%;
Nb: 0.02-0.08%;
V: 0.01-0.15%;
Ti: 0.02-0.05%;
B: 0.0015-0.005%; and
Al: 0.01-0.05%;

wherein a microstructure of the oil casing is tempered sorbite, and wherein the oil casing has a yield strength of 810-965 MPa.

2. The oil casing according to claim 1, characterized in that the content of each chemical element in percentage by mass satisfies the following:

C: 0.08-0.18%;
Si: 0.1-0.4%;
Mn: 0.1-0.28%;
Cr: 0.2-0.8%;
Mo: 0.2-0.6%;
Nb: 0.02-0.08%;
V: 0.01-0.15%;
Ti: 0.02-0.05%;
B: 0.0015-0.005%;
Al: 0.01-0.05%; and
the balance of Fe and other inevitable impurities.

3. The oil casing according to claim 2, characterized in that the inevitable impurities comprise S, P and N, wherein contents of S, P and N satisfy at least one of: P≤0.015%, 0<N≤0.008%, and S≤0.003%.

4. The oil casing according to claim 2, characterized in that the content of each chemical element in percentage by mass satisfies at least one of the following:

C: 0.1-0.16%;
Si: 0.15-0.35%;
Mn: 0.15-0.25%;
Cr: 0.4-0.7%;
Mo: 0.25-0.5%;
Nb: 0.02-0.06%;
V: 0.05-0.12%;
Ti: 0.02-0.04%;
B: 0.0015-0.003%; and
Al: 0.015-0.035%.

5. The oil casing according to claim 2, characterized in that the oil casing has properties satisfying at least one of: a tensile strength of ≥862 MPa, an elongation rate of ≥18%, a residual stress of ≤120 MPa, a 0° C. transverse charpy impact energy of ≥80 J, and an anti-collapse strength of 55 MPa or more at a specification of Φ244.48*11.99 mm, which exceeds the required value of the API standard by 40% or more.

6. The oil casing according to claim 1, characterized in that the content of each chemical element in percentage by mass satisfies at least one of the following:

C: 0.1-0.16%;
Si: 0.15-0.35%;
Mn: 0.15-0.25%;
Cr: 0.4-0.7%;
Mo: 0.25-0.5%;
Nb: 0.02-0.06%;
V: 0.05-0.12%;
Ti: 0.02-0.04%;
B: 0.0015-0.003%; and
Al: 0.015-0.035%.

7. The oil casing according to claim 1, characterized in that the oil casing has properties satisfying at least one of: a tensile strength of ≥862 MPa, an elongation rate of ≥18%, a residual stress of ≤120 MPa, a 0° C. transverse charpy impact energy of ≥80 J, and an anti-collapse strength of 55 MPa or more at a specification of Φ244.48*11.99 mm, which exceeds the required value of the API standard by 40% or more.

8. A manufacturing method for the oil casing according to claim 1, comprising the steps of:

(1) smelting and continuous casting;
(2) perforating, rolling, and sizing;
(3) controlled cooling: an initial cooling temperature being Ar3+30° C. to Ar3+70° C., and a final cooling temperature being ≤80° C.; the cooling step being performed only to an outer surface of the casing without performing to an inner wall of the casing; and controlling a cooling rate to be 30-70° C./s;
(4) tempering; and
(5) thermal straightening.

9. The manufacturing method according to claim 8, characterized in that in the continuous casting of the step (1), controlling a superheat degree of molten steel to be less than 30° C., and a pulling rate of the continuous casting to be 1.6-2.0 m/min.

10. The manufacturing method according to claim 8, characterized in that in the step (2), a round billet is subjected to soaking in a furnace at 1260-1290° C.; a perforating temperature is controlled to be 1180-1260° C.; a final rolling temperature is controlled to be 900-980° C.; and a sizing temperature after final rolling is 850-920° C.

11. The manufacturing method according to claim 8, characterized in that in the step (4), a tempering temperature is 500-600° C., and a holding time is 50-80 min.

12. The manufacturing method according to claim 8, characterized in that in the step (4), a thermal straightening temperature is 400-500° C.

* * * * *